United States Patent [19]

Metcoff et al.

[11] Patent Number: 4,765,516

[45] Date of Patent: Aug. 23, 1988

[54] AEROSOL TILT VALVE MOUNTING CUP AND ASSEMBLY

[75] Inventors: Dale M. Metcoff, Flossmoor, Ill.; Walter Holzboog, Ballwin, Mo.

[73] Assignee: Epic Corporation, Chesterfield, Mo.

[21] Appl. No.: 939,671

[22] Filed: Dec. 9, 1986

Related U.S. Application Data

[63] Continuation of Ser. No. 755,413, Jul. 15, 1985, abandoned.

[51] Int. Cl.[4] ..... B65D 83/14

[52] U.S. Cl. ..... 222/402.22; 251/354

[58] Field of Search ..... 222/402.21–402.24; 251/349, 354

[56] References Cited

U.S. PATENT DOCUMENTS 4,171,074 10/1979 Diamond ..... 222/402.22

4,171,757 10/1979 Diamond ..... 222/402.22 X

FOREIGN PATENT DOCUMENTS 928841 6/1963 United Kingdom ..... 222/402.23

*Primary Examiner*—Charles A. Marmor

*Attorney, Agent, or Firm*—James W. Potthast

[57] ABSTRACT

An aerosol tilt valve assembly (30, 30') with a valve cup (32) for mounting of a grommet (34) and valve stem (36) includes an annular shoulder (32K, 42A, 42B) formed in the bottom of the cup for strengthening it against distortion from excess aerosol pressures and to otherwise reduce leakage between the valve cup (32) and the grommet (34). In one embodiment, the shoulder (32K) defines a recess for mating receipt of the grommet (34). In another embodiment, the shoulder (42A, 42B) defines a portion of both a reservoir groove (44) and a complementary strengthening rib 42.

3 Claims, 2 Drawing Sheets

AEROSOL TILT VALVE MOUNTING CUP AND ASSEMBLY

This application is a continuation of application Ser. No. 06/755,413, filed 7/15/85 now abandoned.

BACKGROUND OF THE INVENTION

Mounting cups for aerosol tilt valve assemblies of the type shown in FIG. 1 and FIG. 2 are well known. Reference may be made to U.S. Pat. No. 3,954,208 of Brill for a detailed description of the structure and operation of such aerosol tilt valve assemblies, but a brief description will suffice for purposes of describing the present invention.

Referring to FIG. 1, a prior art, or known, tilt valve assembly 10 is seen to include a mounting, or valve, cup 12, a resilient, valve stem mounting grommet 14 and a valve stem 16. All of these elements are symmetrical with respect to a center line axis 18 and are circular in cross sections transverse to the axis 18.

The cup 12 has a tubular, preferably cylindrical, side wall 12A which is joined at one end to a bottom 12B. The opposite end of the side wall 12A defines the open end 12C of the cup 12. A curled peripheral lip 12D surrounding the open end 12C is carried at the opposite end of side wall 12 for mounting connection with a suitable mounting collar 20 at the top 22 of an aerosol container (not shown).

The bottom 12B is generally flat on both the inside and outside of the cup and has a cylindrical collar 12E which surrounds and defines a circular mounting hole 12F.

The grommet 14 is made of resilient rubber-like material and has an elongate neck 14A which extends through mounting hole 12F. A relatively larger body 14B underlies and is normally pressed against the outer surface 12B' of cup bottom 12B. A collar 14C carried by the neck 14A overlies the edge of the peripheral collar to wedge block removal of the grommet neck 14A from mounting hole 12F after full insertion therethrough.

The stem 16 has an elongate tubular body 16A with an outlet 16B from the hollow interior at one end and inlets 16C at the opposite end. The inlets 16C are contained within a chamber 24 defined partially by an enlarged portion 14D' of an axial bore 14D in stem 14. The stem body 16A snugly fits through bore 14D to form a fluid tight seal therebetween.

Likewise, the upper surface 14B' of body 14B is flat and is pressed tight against the flat outer surface 12B' of flat cup bottom 12B to form a seal against passage of fluid therebetween when the stem body 14A is in the non-actuated position, as shown in FIG. 1.

The chamber 24 has an opening which is closed by means of the valve head 16D when the stem 16 is in its non-actuated state, as shown with the stem in an upright position aligned with axis 18.

However, referring to FIG. 2, when the stem 16 is in an actuated, or tilted, position, as shown, the valve head 16D is moved away from sealing engagement with body 14B to open chamber 24 for the entry of fluid 26 from the aerosol container. The fluid 26, being under pressure, is forced from the chamber 24 into inlets 16C and through stem body 16A and out through opening 16B.

Disadvantageously, this tilting action also often creates a small gap 28 between the outside surface 12B' of the cup bottom 12B and upper surface 14B' of grommet body 14B. Repeated tilting can cause increasing amounts of fluid 26 to increase the gap 28 sufficiently to cause leakage of fluid between peripheral collar 12E and collar 14C and onto the exterior of the container and valve cup 12.

A similar leakage problem can occur if the aerosol pressure is sufficient to distort the flat bottom 12B and thereby create a gap 28 between the valve cup 12 and the upper surface 14B' of grommet body 14B. This can result in leakage even when the valve is in its nonactuated position, as shown in FIG. 1. While the pressure can normally be reduced to avoid such undesirable distortion of the valve cup 12, reducing the pressure reduces the amount of fluid 26 which can be stored and retrieved from the aerosol container and thereby disadvantageously decreases the fluid storage capability of the aerosol container.

Other valve assemblies are known which have valve cups with non-flat bodies. These are shown in U.S. Pat. Nos. 2,757,964 of Both et al.; 3,011,686 of Rockwell; 3,074,602 of Shillady et al.; 3,512,685 of Ewald; 3,659,755 of Prussin et al. and 3,866,804 of Stevens. Non-planar container caps or covers, are also known as shown in U.S. Pats. Nos. 2,027,430 of Hansen and 4,467,933 of Wilkinson et al. However, none of these by themselves solve the aforementioned leakage problems of aerosol tilt valve assemblies of the type described above.

SUMMARY OF THE INVENTION

It is therefore an object of the present invention to overcome the aforementioned disadvantages of known aerosol tilt valve cups and assemblies.

This objective is achieved, in part, through provision of a valve cup for an aerosol tilt valve assembly comprising a tubular side wall with a pair of opposite ends, a rim lip attached to one end of the side wall for mounting of the cup to an aerosol container, and a bottom member attached to the other end of the side wall. The bottom member has a central mounting hole therethrough for mating receipt of a neck of a flexible grommet having a relatively wider body to which said neck is attached, and a recess surrounding said mounting hole and having relative dimensions sufficient for nestling receipt therewithin of at least a portion of the grommet body.

The grommet body when mounted to the cup and assembled with a valve stem to form a valve is caused to tilt away from the bottom wall recess during actuation of said valve by a certain extent to form a gap. In one embodiment, the depth of the recess is greater than the extent of said tilt. In this same embodiment, the recess has its own bottom and sidewall, the grommet has a top surface and a peripheral wall, and the side wall of the recess is spaced slightly from the peripheral wall of the grommet when the grommet is nestled within the recess and pressed against the recess bottom. However, the flow path to the gap created between the bottom of the bottom wall recess and the grommet body when the grommet body is tilted away from the bottom of the recess is reduced. In another form of this embodiment, the peripheral wall of the grommet abuts against the side wall of the recess and to that extent either blocks leakage flow or restrains against the tilting movement and thus reduces creation of gap.

It is also an objective to provide a valve cup for an aerosol tilt valve assembly comprising a tubular side wall with a pair of opposite ends, a rim lip attached to one end of the side walls for mounting of the cup to an aerosol container, a substantially flat bottom member attached to the other end of the side wall in which the bottom member includes a central mounting hole extending through the bottom member for mating receipt of a flexible valve stem mounting grommet and a shoulder in the outer surface of the bottom to increase its relative rigidity. In a preferred embodiment, the valve cup includes another shoulder spaced the first mentioned shoulder to form a reservoir groove therewith. Preferably, the shoulders also define part of a strengthening rib at the inner surface of the cup bottom.

A further objective, therefore, is to provide a complete aerosol tilt valve assembly comprising a valve cup with a central mounting hole and a recess surrounding the hole, a valve stem mounting grommet having a body portion abutting the valve cup adjacent the recess and having a stem portion extending through the mounting hole, and a valve stem extending through said grommet to form a valve therewith.

Thus, it is seen that achievement of the above objectives overcomes the aforementioned disadvantages of known assemblies.

BRIEF DESCRIPTION OF THE DRAWINGS

Further advantageous features and objects of the present invention will be made apparent and the foregoing features and objects will be illustrated in the detailed description of the preferred embodiments which is given with reference to the several figures of the drawing, in which.

DETAILED DESCRIPTION

Figure 3:
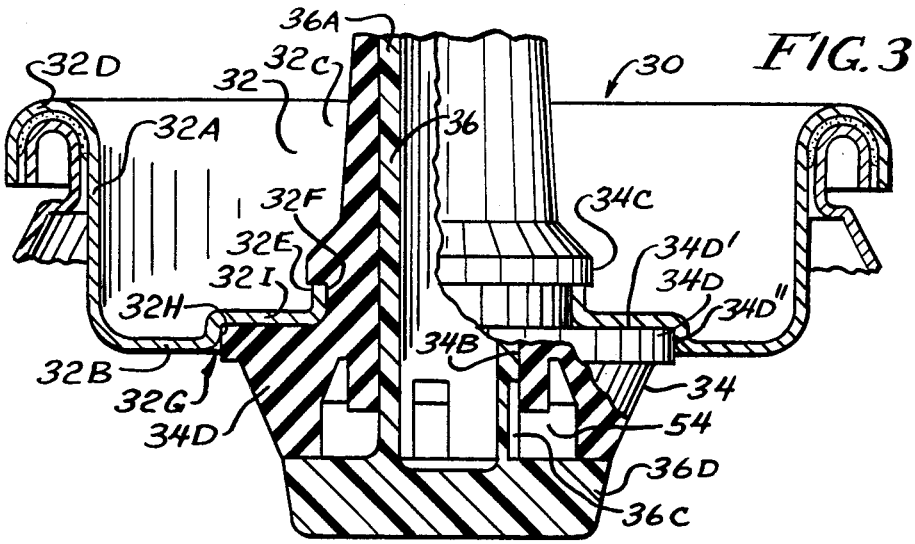
FIG. 3 is a side, partially sectional view of a preferred embodiment of the aerosol tilt valve cup and assembly of the present invention.
Figure 4:
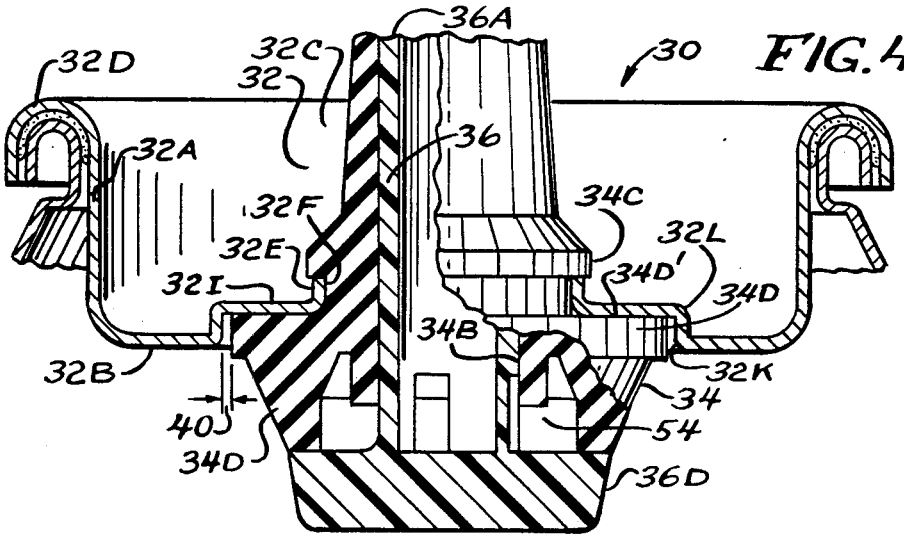
FIG. 4 is a side, partially sectional view of a preferred form of the aerosol tilt valve assembly of FIG. 3.
Figure 5:
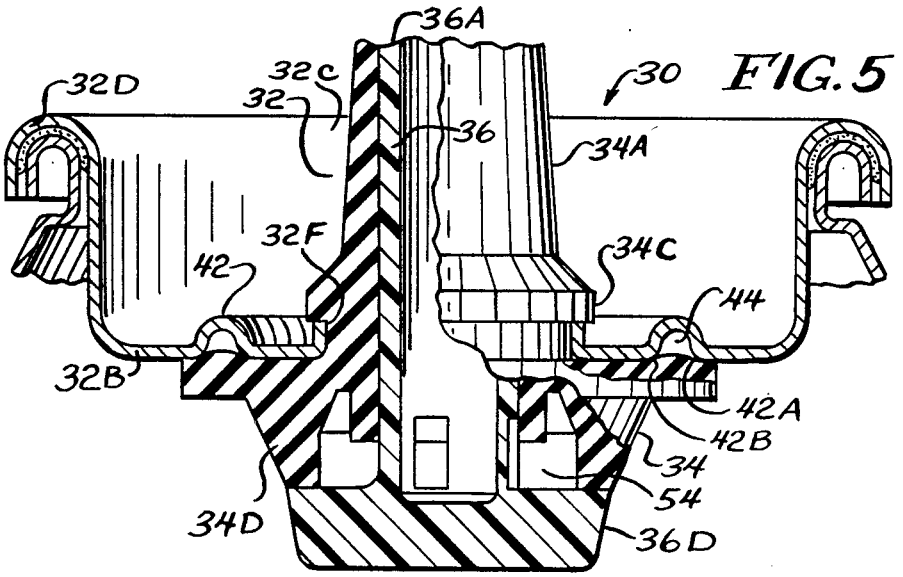
FIG. 5 is a partially sectional side view of another embodiment of the aerosol tilt valve assembly of the invention.

Referring now to FIGS. 3, 4 and 5, preferred embodiments of the improved valve cup and tilt valve assembly 30 are seen to include a valve cup 32 having a tubular, preferably cylindrical side wall 32A, a bottom 32B and an open end 32C with a curled peripheral lip 32D. A central mounting hole 32F in bottom 32B has a peripheral collar 32E surrounding it to engage the underside of a collar 34C surrounding a neck 34A of a resilient valve stem mounting grommet 34. The neck 36A of valve stem 36 extends through a bore 34B and carries inlets 36C within an enclosed portion 34B' defining a chamber 54. A valve head 36D seals a chamber 54 when the valve stem 36 is in its non-tilted, non-actuated position, as shown. When tilted, fluid is allowed into chamber 54 and passes through inlets 36C and out of the open distal end (not shown) of stem 36.

Figure 1:
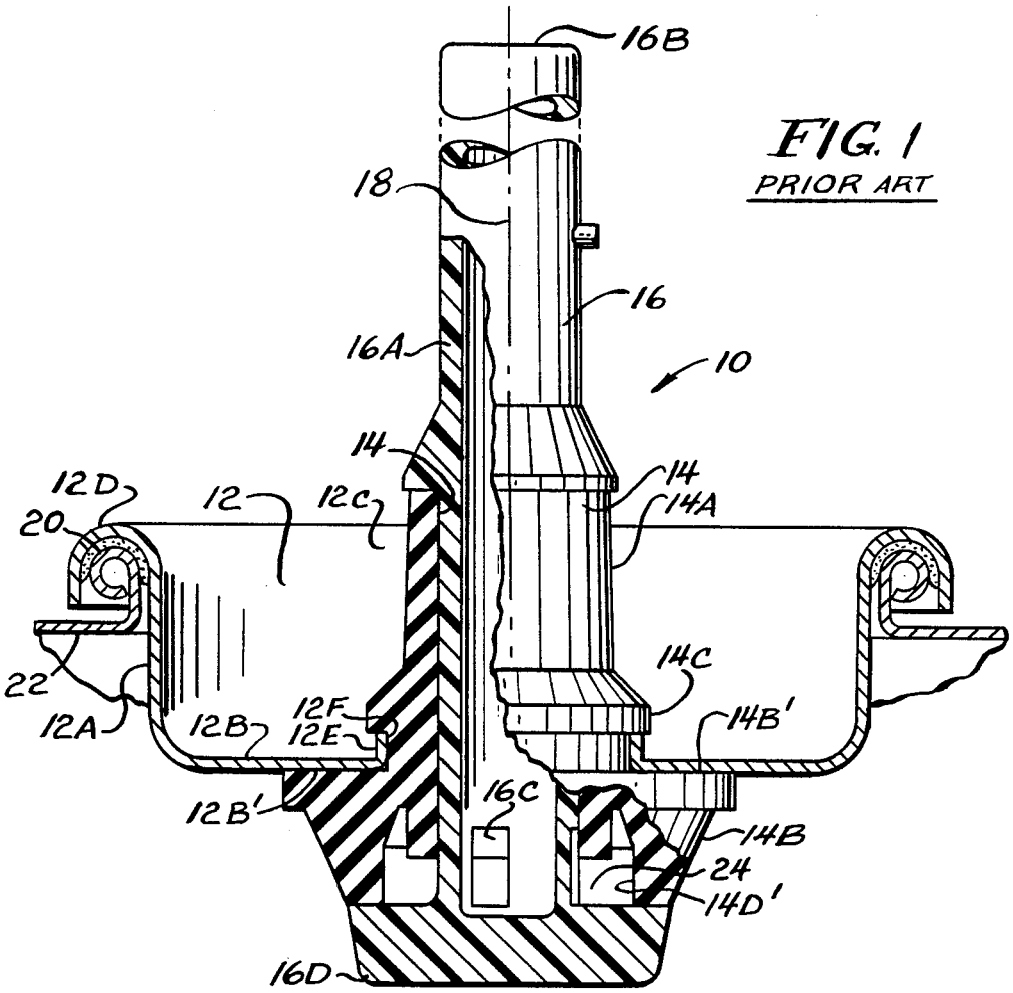
FIG. 1 PRIOR ART
FIG. 1 is a side, partially sectional view of the prior art, or known, tilt valve assemblies referred to in the foregoing background portion.
Figure 2:
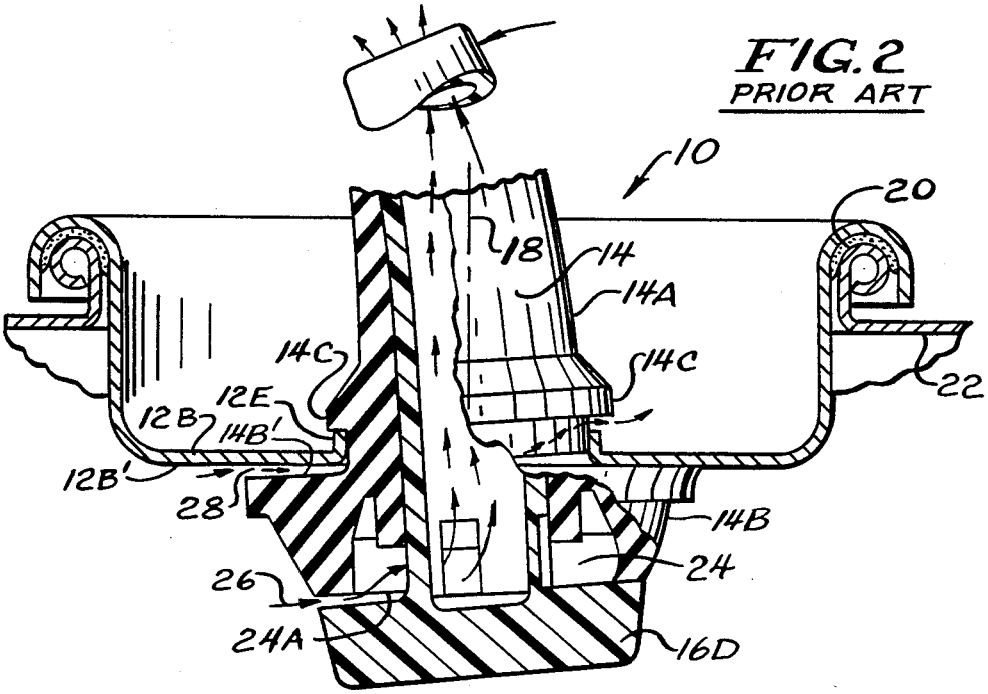
FIG. 2 PRIOR ART
FIG. 2 is another illustration of the known tilt valve assembly of FIG. 1 and referred to above.

Generally, the valve cup 32, grommet 34, stem 36 of FIGS. 3, 4 and 5 and all of their sub-parts are constructed identically to and cooperate with one another in the same fashion as the corresponding parts of the known tilt valve assemblies shown in FIGS. 1 and 2 and described above, except as noted below.

Referring particularly to FIGS. 3 and 4 in the preferred embodiment, the bottom 32B includes a recess 32G having dimensions for nestling receipt therewithin a portion of the relatively wider body 34D of grommet 34. Preferably, the recess 32G has a substantially cylindrical side wall 32H and a substantially flat bottom 32I which is perpendicular to side wall 32H.

Preferably, the depth of recess 32G is greater than the extent of any tilt, or gap, created between the bottom 32I of the recess 32G and the inner, or top, surface 34D' of grommet body 34D.

Referring only to FIG. 3, the part of grommet body 34D which is received within recess 32G is dimensioned to be snugly or tightly received with the recess 32G. Preferably, a peripheral edge wall 34D'' of part 34D abuts against the side wall 32H of recess 32G. In this embodiment, a seal is thereby created which tends to block the entry of fluid into any gap possibly created or, at least, tends to diminish fluid access to the gap 28. In addition, the abutment of wall 34D'' against side wall 32H, tends to block tilting movement of grommet body 34D to reduce or eliminate creation of the gap entirely.

Referring now particularly to FIG. 4, while it may be preferred to have a snug fit, it has been discovered that the advantages of the invention may also be obtained even when there is a gap 40 between the edge wall 34D' and interior of the recess side wall 32H. In the manufacturing process, the metal valve cup is generally stamped from stock by presses, and the recess may gradually enlarge due to wear of the stamping equipment. Further, tilting may be permitted when gap 40 is created, but it is still believed that the access of the fluid to the gap is still restricted relative to the known valve cup of FIGS. 1 and 2, which have no recess. While creation of the gap may not be eliminated, the extent of the gap is still reduced.

Further, the recess 32G of both embodiments of Figs. 3 are defined by shoulders 32K and 32L as seen in FIG. 4. These shoulders function to stiffen the bottom 32B against distortion regardless of gap reduction. These shoulders do not substantially increase the amount of material needed for manufacture of the cup 32, but do significantly reduce the amount of possible distortion of the bottom 32I of the recess which sealingly mates with the part 34D. Advantageously, relatively greater pressure can be used without increasing possible leakage due to cup distortion.

Referring now particularly to FIG. 5, another embodiment of the present invention is seen to include a rib 42 defined by a pair of opposite shoulders 42A and 42B. These shoulders perform the function of stiffening the bottom 32B against distortion to reduce leakage.

In addition, shoulders 42A and 42B also preferably define a groove 44 in the outer side of bottom 32B. Both the rib 42 and the groove 44 are complements of one another as shown, but the groove 44 can be formed separately from the rib 42. The mating surface 34D' of the grommet body 34D is substantially flat. Likewise, the cup bottom 32B is flat except for groove 44. The grommet 34 covers the groove 44, and it is believed that the groove assists in reducing leakage by providing a fluid reservoir for fluid which may enter into the gap between the part 34D and bottom 32B. When the part body returns to a position with surface 34D' pressed against the flat portion of bottom 32B, some of the fluid in the gap may be squeezed into the reservoir instead of toward the mounting hole 32F.

While particular embodiments have been disclosed, this has been done for purposes of illustration of the best mode of practicing the invention. Variations are contemplated and may be apparent to a person of ordinary skill in the art. First, the rib 42 or groove 44 of the embodiment of FIG. 5 could certainly be formed in the bottom 32I of the recess 32G of the embodiment of FIGS. 3 and 4 to obtain the advantages of both embodiments in a single valve cup or valve assembly. Likewise, although the recess 32G, rib 42 and groove 44 are annular in configurations, other configurations are clearly workable. It should also be clear that the upper part 34D of grommet 34 could be formed with an annular rib which is matingly received within the groove 44. Although, this would eliminate the reservoir formed by groove 44, it would tend to reduce separation of the grommet 34 and cup bottom 32B in addition to creating an additional seal despite tilting.

Accordingly, reference should be made to the following claims for a definition of the scope of the present invention.

We claim:

1. An aerosol tilt valve assembly, comprising:

a valve cup with an outside, an inside, a central mounting hole and an inwardly facing recess with a side wall surrounding the hole and having a preselected depth;

a valve stem mounting grommet with a body portion having a valve seat at one end spaced outside of the recess and without a lateral support from said side wall thereat, and a base substantially wider than said valve seat at an opposite end of the body portion, abutting the valve cup and being solitarily nestled within the recess, said base being slightly spaced from the cylindrical side wall by a distance less than the depth of the recess to be engaged thereby during relative pivotal movement therebetween, and a relatively narrower neck extending through the mounting hole; and a valve stem with a tubular body received within an aperture through the seat, base and neck of the grommet to convey fluid therethrough between an inlet at one end and an outlet at an opposite end, and a valve stem head substantially coextensive with said valve seat, spaced from said valve cup recess and mounted for pivotal movement relative thereto with a pivoting edge pressed against and being supported by said valve seat during pivoting to form a valve therewith.

2. The tilt valve assembly of claim 1 in which the body portion has a tapered part extending from said relatively wider base to said valve seat, and said seat has a peripheral seal wall for mating with a planar surface of said valve seat.

3. The tilt valve assembly of claim 2 in which said body portion of the valve stem mounting grommet is tilted away from sealing engagement with the valve cup when the neck portion is tilted to an actuation position by a certain amount due to said spacing between the nestled body portion and the cylindrical side wall, and said recess has a depth which is not substantially less than said certain amount to reduce the entry of material in between the valve cup and the grommet.

* * * * *